US008103516B2

(12) United States Patent
Oshikiri

(10) Patent No.: US 8,103,516 B2
(45) Date of Patent: Jan. 24, 2012

(54) SUBBAND CODING APPARATUS AND METHOD OF CODING SUBBAND

(75) Inventor: Masahiro Oshikiri, Kanagawa (JP)

(73) Assignee: Panasonic Corporation, Osaka (JP)

( * ) Notice: Subject to any disclaimer, the term of this patent is extended or adjusted under 35 U.S.C. 154(b) by 905 days.

(21) Appl. No.: 12/095,548

(22) PCT Filed: Nov. 29, 2006

(86) PCT No.: PCT/JP2006/323841
§ 371 (c)(1),
(2), (4) Date: May 30, 2008

(87) PCT Pub. No.: WO2007/063913
PCT Pub. Date: Jun. 7, 2007

(65) Prior Publication Data

US 2010/0228541 A1 Sep. 9, 2010

(30) Foreign Application Priority Data

Nov. 30, 2005 (JP) ..... 2005-347342

(51) Int. Cl.
*G10L 19/00* (2006.01)
*G10L 19/14* (2006.01)
*G10L 19/02* (2006.01)

(52) U.S. Cl. ..... 704/501; 704/205; 704/229

(58) Field of Classification Search ..... None
See application file for complete search history.

(56) References Cited

U.S. PATENT DOCUMENTS 4,521,646 A * 6/1985 Callaghan ..... 375/240
5,706,392 A * 1/1998 Goldberg et al. ..... 704/200.1
5,857,000 A * 1/1999 Jar-Ferr et al. ..... 375/240
6,680,972 B1 1/2004 Liljeryd et al.
7,333,929 B1 * 2/2008 Chmounk et al. ..... 704/200
7,693,709 B2 * 4/2010 Thumpudi et al. ..... 704/205
2002/0007280 A1 1/2002 McCree
2002/0052738 A1 5/2002 Parsoy et al.
2002/0134878 A1 9/2002 Kohai
2004/0078194 A1 4/2004 Liljeryd et al.
(Continued)

FOREIGN PATENT DOCUMENTS

EP 1158495 11/2001
(Continued)

OTHER PUBLICATIONS

Bosi et al., "ISO/IEC MPEG-2 Advanced Audio Coding", Presented at the 101st Convention of the Audio Engineering Society, Nov. 8-11, 1996.*

(Continued)

*Primary Examiner* — Brian Albertalli
(74) *Attorney, Agent, or Firm* — Greenblum & Bernstein, P.L.C.

(57) ABSTRACT

A subband coding apparatus carries out subband coding which prevents deterioration in coding performance and improves audio quality of decoded signals. The subband coding apparatus includes a low-band coding section (103) to code a low-band spectrum (S13). A low-band decoding section (106) decodes a low-band coded data (S14) and outputs a decoded low-band spectrum (S18) to a high-band coding section (107). A spectrum rearranging section (105) rearranges to make each frequency component of a high-band spectrum (S16) in reverse order on the frequency axis and outputs a modified high-band spectrum (S17) after rearranging to a high-band coding section (107). The high-band coding section (107) uses the decoded low-band spectrum (S18) output from the low-band decoding section (106) to code the modified high-band spectrum (S17) output from the spectrum rearranging section (105).

6 Claims, 17 Drawing Sheets

U.S. PATENT DOCUMENTS

| | | | | |
|---|---|---|---|---|
| 2004/0078205 | A1 | 4/2004 | Liljeryd et al. | |
| 2004/0125878 | A1 | 7/2004 | Liljeryd et al. | |
| 2007/0253481 | A1 | 11/2007 | Oshikiri | |
| 2008/0052066 | A1 | 2/2008 | Oshikiri et al. | |
| 2008/0091440 | A1 | 4/2008 | Oshikiri | |
| 2008/0126082 | A1 | 5/2008 | Ehara et al. | |
| 2008/0154583 | A1 | 6/2008 | Goto et al. | |
| 2010/0211399 | A1 * | 8/2010 | Liljeryd et al. | 704/500 |

FOREIGN PATENT DOCUMENTS

| | | |
|---|---|---|
| JP | 9-258787 | 10/1997 |
| JP | 2001-337700 | 12/2001 |
| JP | 2003-216190 | 7/2003 |
| JP | 2005-173607 | 6/2005 |

OTHER PUBLICATIONS

Esteban et al., "Application of Quadrature Mirror Filters to Split Band Voice Coding Schemes", IEEE Int Conf on Acoust, Speech and Signal Process, Rec, 1977, pp. 191-195, XP002554823.

Oshikiri et al., "Efficient spectrum coding for super-wideband speech and its application to 7/10/15 KHz bandwidth scalable coders", Acoustics, Speech, and Signal Processing, 2004, Proceedings, (ICASSP '04), IEEE International Conference on Montreal Quebec, Canada May 17-21, 2004, Piscataway, NJ, USA, IEE, vol. 1, May 17, 2004, pp. 481-484, XP010717670.

Oshigiri et al., "Pitch Filtering ni yoru Taiiki Kakucho Gijutsu o Mochiita 7/10/15kHz Taiiki Scalable Onsei Fugoka Hoshiki", the Acoustical Society of Japan (ASJ), 2004 Nen Shunki Kenkyu Happyokai Koen Ronbunshu-I-, Mar. 17, 2004, pp. 327-328.

"Scalable Wideband Speech Coding using G. 729 as a component,"Kataoka et al., the Institute of Electronics, Information and Communication Engineers paper D-II, Mar. 2003, vol. J86-D-II, No. 3, pp. 379-387.

"A 7/10/15 kHz bandwidth scalable coder using pitch filtering spectrum coding,"Oshikiri et al., Annual Meeting of Acoustic Society of Japan Article 3-11-4, Mar. 2004, pp. 327 -328.

* cited by examiner

INTENSITY
Fs/4
Fs/2
FREQUENCY

Fs/4
Fs/2

Fs/4
Fs/2

Fs/4

Fs/4

SUBBAND CODING APPARATUS AND METHOD OF CODING SUBBAND

TECHNICAL FIELD

The present invention relates to a subband coding apparatus and subband coding method for encoding mainly wideband speech signals using band division filter such as QMF.

BACKGROUND ART

A mobile communication system is required to compress a speech signal to a low bit rate for effective use of radio resources. Further, improvement of communication speech quality and realization of communication services of high fidelity are demanded by users. To meet these demands, it is preferable to use wideband speech (7 kHz signal band) of wider bands than narrowband speech (3.4 kHz signal band) used in conventional speech communication.

A technique referred to as "subband coding" is known as a method of encoding wideband signals. Subband coding refers to dividing input signals into a plurality of bands and encoding each band independently. Each band is down-sampled after the band division, and so the total number of signal samples is the same as before the band division is carried out. For the band division, a QMF (Quadrature Mirror Filter) is used in many cases. The QMF divides a signal band into two, and aliasing distortion of the low band filter and the high band filter cancel each other. For this reason, there are advantages that, for example, the cut-off characteristics of a filter need not to be so steep.

Typical coding schemes using the QMF include G.722, which is standardized by the ITU-T (International Telecommunication Union-Telecommunication Standardization Sector). G.722 is also referred to as SB-ADPCM (Sub-Band Adaptive Differential Pulse Code Modulation), and refers to dividing an input signal of 16 kHz sampling frequency into two bands, the low band signal (8 kHz sampling frequency) and the high band signal (8 kHz sampling frequency), through the QMF, and quantizing the signals of the respective bands by ADPCM. The low band signal is quantized at four to six bits per sample and the high band signal is quantized at two bits per sample, and the bit rates support three kinds of 48 kbits/sec (upon quantization of the low band signal at four bits per sample), 56 kbits/sec (upon quantization of the low band signal at five bits per sample) and 64 kbits/sec (upon quantization of the low band signal at six bits per sample).

For example, there is a technique of carrying out band division of a wideband signal to the low band signal and the high band signal through the QMF and carrying out CELP (Code Excited Linear Prediction) coding of the low band signal and the high band signal (for example, see Non-Patent Document 1). This technique realizes high speech quality coding at a bit rate of 16 kbits/sec (12 kbits/sec for the low band signal and 4 kbits/sec for the high band signal). Further, the sampling frequency for the low band signal and the high band signal is half the sampling frequency for an input signal, and, compared to cases where the input signal is encoded without carrying out band division, the amount of operation in the processing (for example, convolution processing) requiring the amount of operation proportional to the square of the signal length becomes little, so that it is possible to realize a less amount of operation.

Further, there is a technique of encoding the high band of a spectrum with high efficiency utilizing the low band of the spectrum and realizing lower bit rates (see Non-Patent Document 2).

Non-Patent Document 1: "Scalable Wideband Speech Coding using G.729 as a component," Kataoka et al., the Institute of Electronics, Information and Communication Engineers paper D-II, March 2003, Vol. J86-D-II, No. 3, pp. 379 to 387.

Non-Patent Document 2: "A 7/10/15 kHz bandwidth scalable coder using pitch filtering spectrum coding," Oshikiri et al., Annual Meeting of Acoustic Society of Japan Article 3-11-4, March 2004, pp. 327 to 328.

DISCLOSURE OF INVENTION

Problems to be Solved by the Invention

Subband coding that divides an input signal into a plurality of bands using a band division filter such as a QMF and that carries out coding per band, is realized with a low amount of operation. However, if, for example, the technique disclosed in Non-Patent Document 2 is applied to subband coding, that is, if the technique of encoding the high band using the low band of the spectrum is applied to subband coding, there is a problem that a mirror image spectrum is generated. This problem will be described in detail using FIG. 1 and FIG. 2.

FIG. 1 shows a configuration of band dividing section 10 that divides an input signal into the low band signal and the high band signal using filter 11 (H0) and filter 13 (H1) as an example of subband coding.

H0 is a low pass filter with the pass band in the range of 0 to Fs/4. Further, H1 is a high pass filter with the pass band in the range of Fs/4 to Fs/2. The sampling frequency for an input signal is Fs.

FIG. 2 illustrates how an input spectrum changes in band dividing section 10.

Band dividing section 10 receives an input of spectrum S1 of sampling frequency Fs shown in FIG. 2A and gives this spectrum S1 to H0 and H1. H0 cuts off the high band of input spectrum S1 and obtains spectrum S2 shown in FIG. 2B. Extracting section 12 extracts spectrum S2 every other sample and generates low band spectrum S3 shown in FIG. 2D. On the other hand, H1 cuts off the low band of input spectrum S1 similar to the case of H0 and obtains spectrum S4 shown in FIG. 2C. Extracting section 14 extracts spectrum S4 every other sample and generates high band spectrum S5 shown in FIG. 2E. At this time, samples are extracted every other sample in extracting section 14, and so aliasing occurs in a spectrum and the shape of spectrum S5 shows a mirror image of spectrum S4. Incidentally, although similar aliasing occurs in extracting section 12, the high band of spectrum S2 is cut off, and so aliasing does not occur in spectrum S3.

In this way, in subband coding, even if the high band of a spectrum is subject to coding utilizing the low band of a spectrum, a mirror image spectrum is generated in the high band, and so this spectrum that accurately reflects the spectrum of the source signal is not obtained, and, as a result, coding performance deteriorates and decoded signal sound quality deteriorates.

It is therefore an object of the present invention to provide a subband coding apparatus and a subband coding method for preventing of coding performance deterioration and improving decoded signal sound quality in subband coding.

Means for Solving the Problem

The subband coding apparatus according to the present invention employs a configuration including: a dividing section that divides an input signal into a plurality of subband signals; a transforming section that carries out a frequency domain transform of the subband signal and generates a subband spectrum; a rearranging section that rearranges an order of spectral components in the subband spectrum to be reverse and generates a reverse order spectrum; and a coding section that encodes the reverse order spectrum.

Advantageous Effect of the Invention

In subband coding, the present invention is able to prevent coding performance deterioration and improve decoded signal sound quality.

BEST MODE FOR CARRYING OUT THE INVENTION

Embodiments of the present invention will be described in detail with reference to the accompanying drawings.

Embodiment 1

Figure 3:
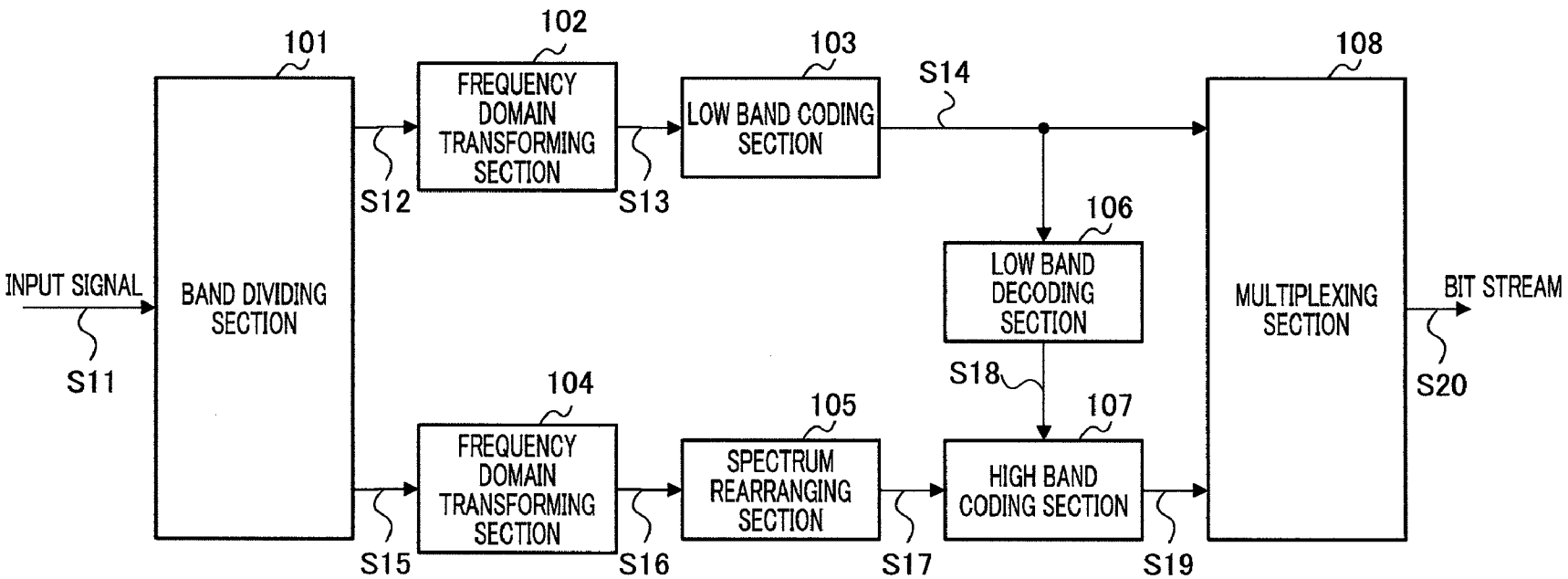
FIG. 3 is a block diagram showing a main configuration of a subband coding apparatus according to Embodiment 1.

FIG. 3 is a block diagram showing the configuration of the subband coding apparatus according to Embodiment 1 of the present invention.

The subband coding apparatus according to this embodiment has band dividing section 101, frequency domain transforming section 102, low band coding section 103, frequency domain transforming section 104, spectrum rearranging section 105, low band decoding section 106, high band coding section 107 and multiplexing section 108, receives an input of input signal S11 of sampling frequency Fs and outputs bit stream S20 obtained by multiplexing low band coded data and high band coded data.

Sections of the subband coding apparatus according to this embodiment will carry out following operations.

Figure 1:
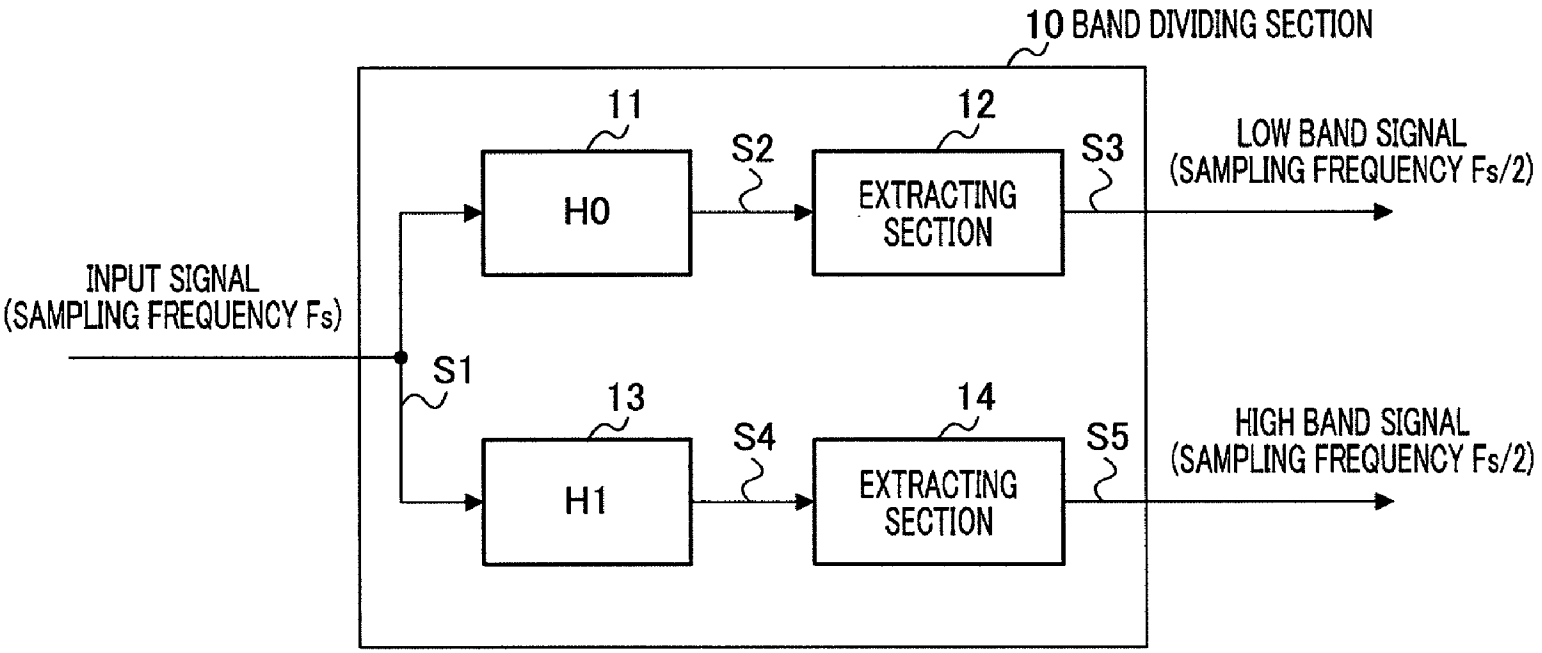
FIG. 1 shows an example of subband coding.
Figures 2A, 2B, 2C, 2D, 2E:
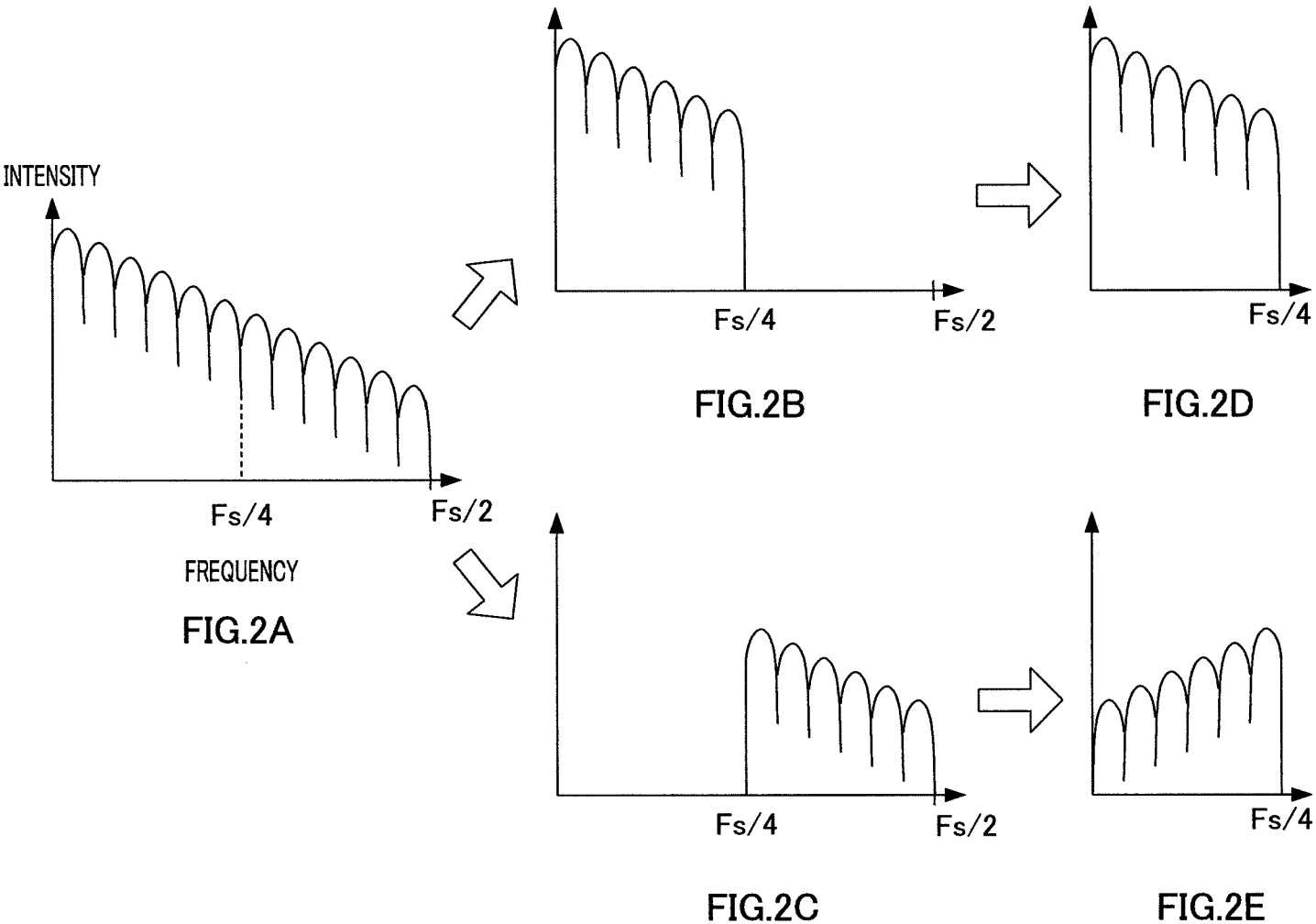
FIG. 2 illustrates how an input spectrum changes in a band dividing section.

Band dividing section 101 has the same configuration as band dividing section 10 shown in FIG. 1, divides band $0 \leqq k < Fs/2$ (where k is the frequency) into subbands, the low band and the high band, and generates low band signal S12 of the band $0 \leqq k < Fs/4$ and high band signal S15 of the band $Fs/4 \leqq k < Fs/2$. The sampling frequency for both of these signals is Fs/2. Low band signal S12 and high band signal S15 are outputted to frequency domain transforming section 102 and frequency domain transforming section 104, respectively.

Frequency domain transforming section 102 transforms low band signal S12 into low band spectrum S13 as a frequency domain signal and outputs low band spectrum S13 to low band coding section 103. Techniques such as MDCT (Modified Discrete Cosine Transform) are used for the frequency domain transform.

Low band coding section 103 encodes low band spectrum S13. To encode the low band spectrum, transform coding such as AAC (Advanced Audio Coder) or TwinVQ (Transform Domain Weighted Interleave Vector Quantization) is used. Low band coded data S14 obtained in low band coding section 103 is outputted to multiplexing section 108 and low band decoding section 106.

Low band decoding section 106 decodes low band coded data S14, generates decoded low band spectrum S18 and outputs decoded low band spectrum S18 to high band coding section 107.

Similar to frequency domain transforming section 102, frequency domain trans forming section 104 transforms high band signal S15 into high band spectrum S16 as a frequency domain signal, and outputs high band spectrum S16 to spectrum rearranging section 105.

Spectrum rearranging section 105 rearranges the spectral components of high band spectrum S16 such that the order of the spectral components is reverse in the frequency domain. Here, the spectral components of the spectrum refer to, for example, MDCT coefficients when MDCT is applied in the frequency transform or refer to FFT coefficients when the FFT (Fast Fourier Transform) is applied. By means of this rearrangement processing, out of spectra of an input signal, the order in the high band spectrum showing a mirror image is rearranged correctly. Corrected high band spectrum S17 after the rearrangement is outputted to high band coding section 107.

High band coding section 107 encodes corrected high band spectrum S17 outputted from spectrum rearranging section 105 by utilizing decoded low band spectrum S18 outputted from low band decoding section 106 and outputs resulting high band coded data S19 to multiplexing section 108.

Multiplexing section 108 multiplexes low band coded data S14 outputted from low band coding section 103 and high band coded data S19 outputted from high band coding section 107 and outputs resulting bit stream S20.

Figure 4:
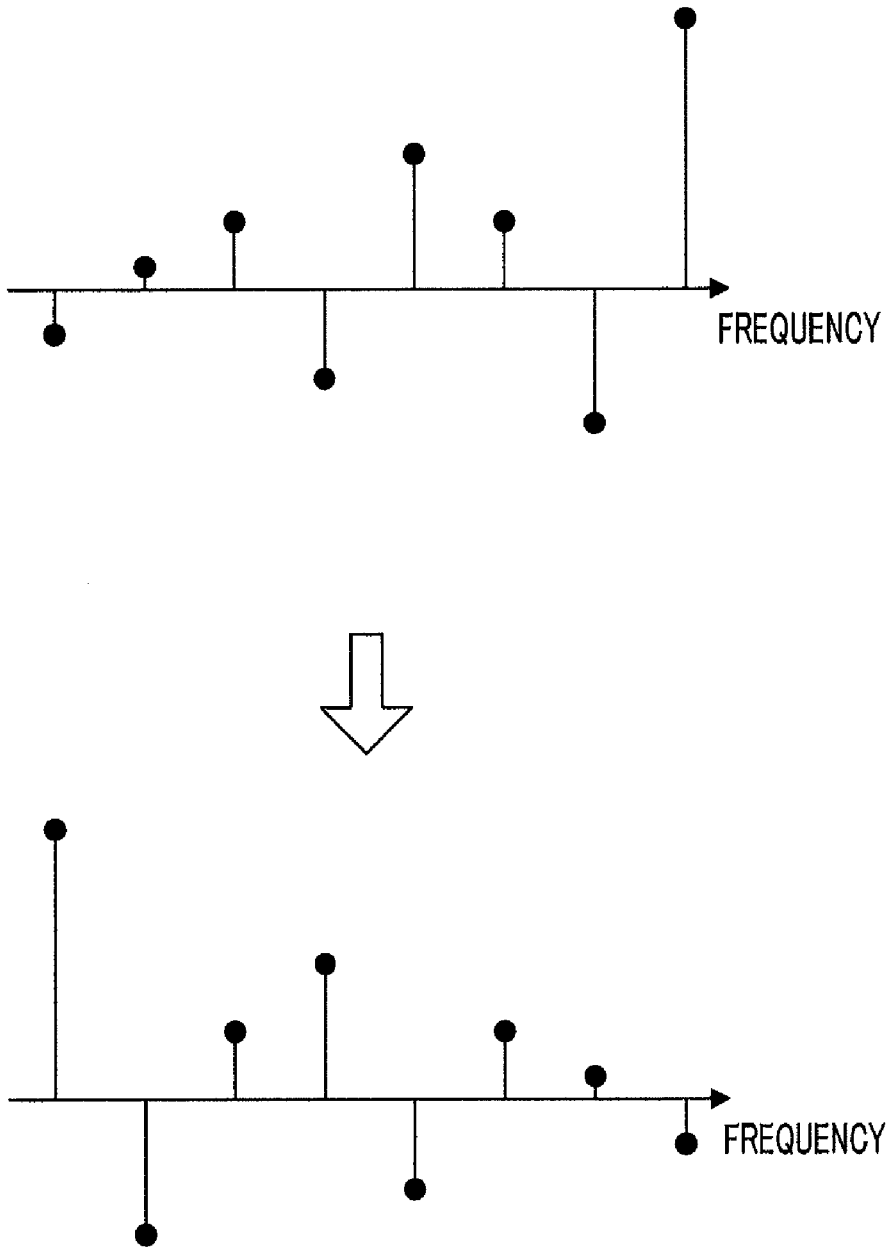
FIG. 4 illustrates an outline of subband spectrum rearrangement processing according to Embodiment 1.

FIG. 4 illustrates an outline of spectrum rearrangement processing in spectrum rearranging section 105.

Upper part of FIG. 4 shows (an example of) high band spectrum S16 inputted to spectrum rearranging section 105, and lower part of FIG. 4 shows corrected high band spectrum S17 outputted from spectrum rearranging section 105. As shown in this figure, in spectrum rearranging section 105, the order of the spectral components in inputted high band spectrum S16 is rearranged to be reverse in the frequency domain.

Figure 5:
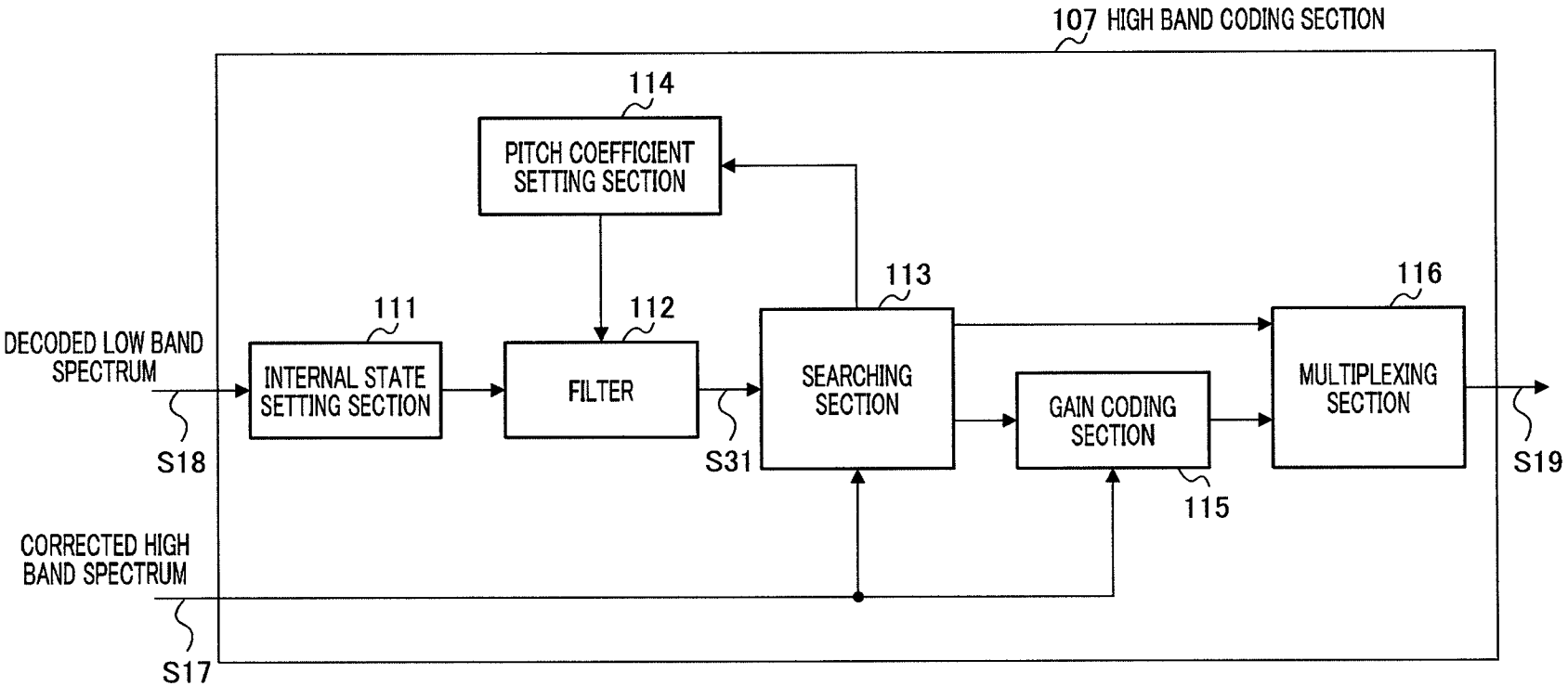
FIG. 5 is a block diagram showing a main configuration inside a high band coding section according to Embodiment 1.

FIG. 5 is a block diagram showing a main configuration inside above high band coding section 107.

High band coding section 107 regards corrected high band spectrum S17 as the target spectrum and finds estimated spectrum S31 of corrected high band spectrum S17 by shifting decoded low band spectrum S18 by the frequency determined according to the following optimization loop and adjusting power. Then, high band coded data S19 representing this estimated spectrum S31 is outputted to multiplexing section 108.

To be more specific, sections of high band coding section 107 will carry out the following operations.

Internal state setting section 111 sets the internal state of the filter used at filter 112 using decoded low band spectrum S18 of band 0≦k<Fs/4.

According to control by searching section 113, pitch coefficient setting section 114 outputs pitch coefficient T sequentially to filter 112 by changing pitch coefficient T in the search range of $T_{min}$ to $T_{max}$ determined in advance.

Filter 112 performs filtering processing of decoded low band spectrum S18 based on the internal state of the filter set by internal state setting section 111 and pitch coefficient T outputted from pitch coefficient setting section 114 and calculates estimated spectrum S31 of corrected high band spectrum S17. This filtering processing will be described in detail below.

Searching section 113 calculates the correlation, which is a parameter showing similarity, between corrected high band spectrum S17 of band Fs≦k<Fs/2 and estimated spectrum S31 outputted from filter 112. Here, corrected high band spectrum S17 represents a signal of band Fs/4≦k<Fs/2, but data in time domain from corrected high band spectrum S17 is extracted at band dividing section 101, and so, in practice, corrected high band spectrum S17 presents a signal of band 0≦k<Fs/4. Further, processing of calculating the correlation provides a optimization loop and is carried out every time pitch coefficient T is given from pitch coefficient setting section 114 to output the index showing the pitch coefficient that maximizes the calculated correlation, that is, the index showing optimum pitch coefficient T' (in the range of $T_{min}$ to $T_{max}$), to multiplexing section 116. Further, searching section 113 outputs estimated spectrum S31 generated using this optimum pitch coefficient T' to gain coding section 115.

Gain coding section 115 calculates gain information of corrected high band spectrum S17 based on estimated spectrum S31. To be more specific, gain information is represented by spectral power per subband, and frequency band Fs/4≦k<Fs/2 is divided into J spectra. Further, a "subband" used to describe gain coding section 115 is different from a subband in the above "subband coding," and refers to a narrower band. Spectral power B(j) of the j-th subband is represented by following equation 1.

(Equation 1)

$$B(j) = \sum_{k=BL(j)}^{BH(j)} S2(k)^2 \quad [1]$$

Here, BL(j) is the minimum frequency of the j-th subband, BH(j) is the maximum frequency of the j-th subband and S2(*k*) is corrected high band spectrum S17. Subband information of the corrected high band spectrum determined in this way is regarded as gain information of the corrected high band spectrum.

Further, gain coding section 115 calculates subband information B'(j) of estimated spectrum S31 according to equation 2.

(Equation 2)

$$B'(j) = \sum_{k=BL(j)}^{BH(j)} S2'(k)^2 \quad [2]$$

Here, S2'(k) is estimated spectrum S31 of corrected high band spectrum S17.

Then, gain coding section 115 calculates the variation V(j) per subband according to following equation 3.

(Equation 3)

$$V(j) = \sqrt{\frac{B(j)}{B'(j)}} \quad [3]$$

Next, gain coding section 115 finds the encoded variation $V_q(j)$ by encoding the variation V(j) and outputs this index to multiplexing section 116.

Multiplexing section 116 multiplexes the index showing the optimum pitch coefficient outputted from searching section 113 and the index showing the encoded variation $V_q(j)$ outputted from gain coding section 115, and outputs the result as coded data S19.

Figure 6:
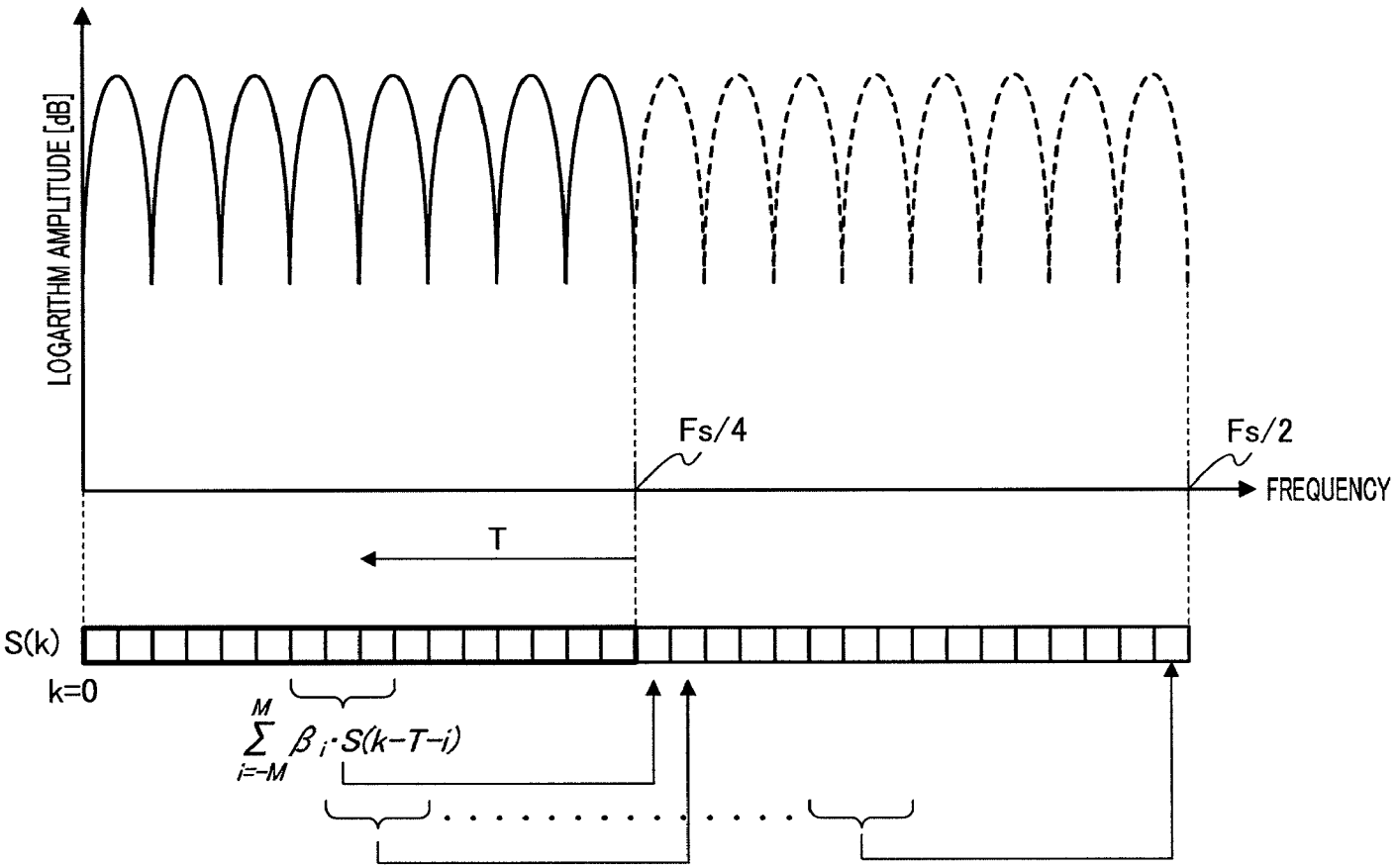
FIG. 6 illustrates in detail filtering processing according to Embodiment 1.

FIG. 6 illustrates in detail filtering processing in filter 112.

Filter 112 generates estimated spectrum S31 of corrected high band spectrum S17 (band Fs/4≦k<Fs/2).

Here, the spectrum of full frequency band (0≦k<Fs/2) is represented by S(k), decoded low band spectrum S18 is represented by S1(*k*) and estimated spectrum S31 of corrected high band spectrum S17 is represented by S2'(k).

Further, what is represented by following equation 4 is used as the filter function.

(Equation 4)

$$P(z) = \frac{1}{1 - \sum_{i=-M}^{M} \beta_i z^{-T+i}} \quad [4]$$

In this equation, T is the pitch coefficient given from pitch coefficient setting section 114 and M=1.

As shown in FIG. 6, in band 0≦k<Fs/4 of S(k), S1(*k*) is stored as the internal state of the filter. On the other hand, in band Fs/4≦k<Fs/2 of S(k), S2'(k) determined by following steps is stored.

The spectral component obtained by adding all spectral components $\beta_i \cdot S(k-T-i)$ obtained by multiplying neighborhood spectral components S(k−T−i), which is spaced apart by i from spectral component S(k−T) of the frequency lowered by T from k as the center, by predetermined weighting coefficient $\beta_i$, that is, the spectral component represented by equation 5, is obtained for S2'(k) by filtering processing. Then, S2'(k) where Fs/4≦k<Fs/2 is calculated by carrying out this operation changing k in the range of Fs/4≦k<Fs/2 sequentially from k=Fs/4.

(Equation 5)

$$S2'(k) = \sum_{i=-1}^{1} \beta_i \cdot S(k - T - i) \quad [5]$$

The above filtering processing provides the optimization loop carried out by subjecting S(k) to zero clear in the range of Fs/4≦k<Fs/2 every time pitch coefficient T is given from pitch coefficient setting section 114. That is, every time pitch coefficient T changes, S2'(k) is calculated and outputted to searching section 113.

Figure 7:
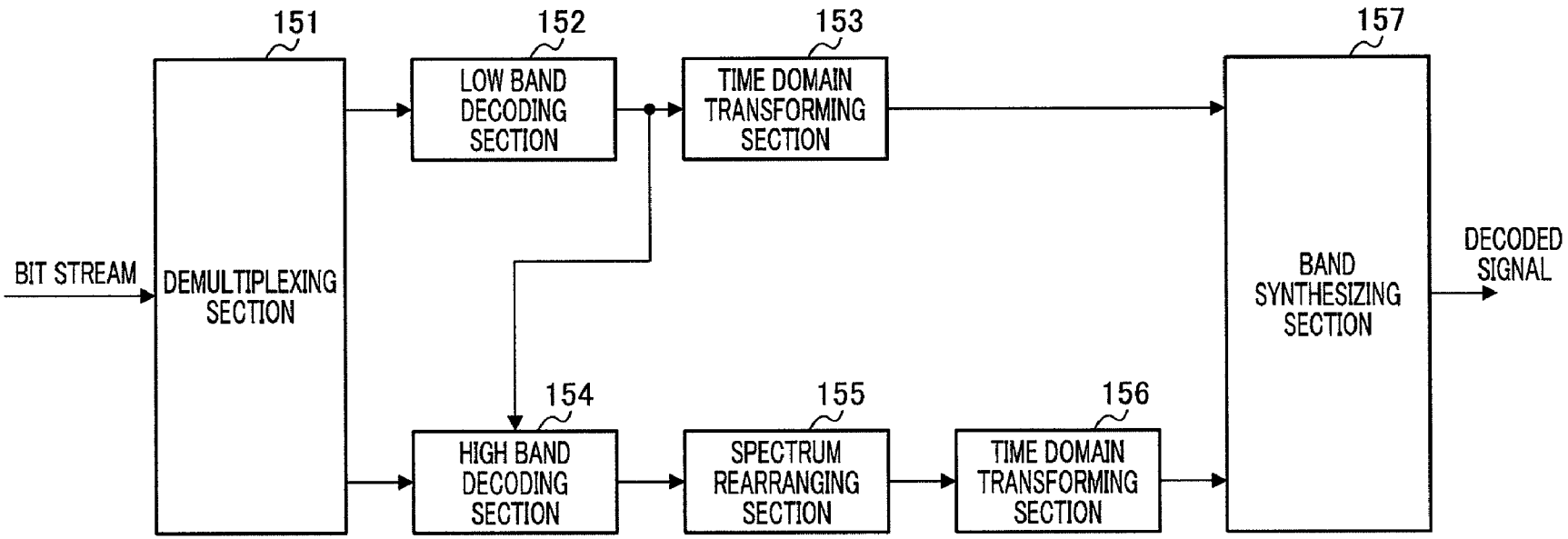
FIG. 7 shows a configuration of a subband decoding apparatus according to Embodiment 1.

Next, the configuration of the subband decoding apparatus according to this embodiment which supports the above subband coding apparatus will be described using FIG. 7.

Demultiplexing section 151 separates low band coded data and high band coded data from a bit stream and outputs the low band coded data and the high band coded data to low band decoding section 152 and high band decoding section 154, respectively.

Low band decoding section 152 decodes the low band coded data outputted from demultiplexing section 151, generates the decoded low band spectrum and outputs this spectrum to time domain transforming section 153 and high band decoding section 154.

Time domain transforming section 153 transforms the decoded low band spectrum outputted from low band decoding section 152 into a time domain signal and outputs the resulting decoded low band signal to band synthesizing section 157.

High band decoding section 154 generates a decoded high band spectrum using the high band coded data outputted from demultiplexing section 151 and the decoded low band spectrum outputted from low band decoding section 152 and outputs the decoded high band spectrum to spectrum rearranging section 155.

By rearranging the order of spectral components in the decoded high band spectrum outputted from high band decoding section 154 to be reverse in the frequency domain, spectrum rearranging section 155 corrects the decoded high band spectrum such that the decoded high band spectrum shows a mirror image, and gives the resulting corrected decoded high band spectrum to time domain transforming section 156.

Time domain transforming section 156 transforms the corrected decoded high band spectrum outputted from spectrum rearranging section 155 into a time domain signal and outputs the resulting decoded high band signal to band synthesizing section 157.

Band synthesizing section 157 synthesizes a signal of sampling frequency Fs using the decoded low band signal of sampling frequency Fs/2 outputted from time domain transforming section 153 and the decoded high band signal of sampling frequency Fs/2 outputted from time domain transforming section 156, and outputs the result as a decoded signal. To be more specific, band synthesizing section 157 generates an up-sampled decoded low band signal by inserting a zero value sample every other sample of the decoded low band signal and then passing this signal through a low pass filter with the pass band in the range of 0 to Fs/4. Further, band synthesizing section 157 generates an up-sampled decoded high band signal by inserting a zero value sample with respect to the decoded high band signal every other sample and then passing this signal through a high pass filter with the pass band in the range of Fs/4 to Fs/2. Then, band synthesizing section 157 adds the up-sampled decoded low band signal and the up-sampled decoded high band signal, and generates an output signal.

Figure 8:
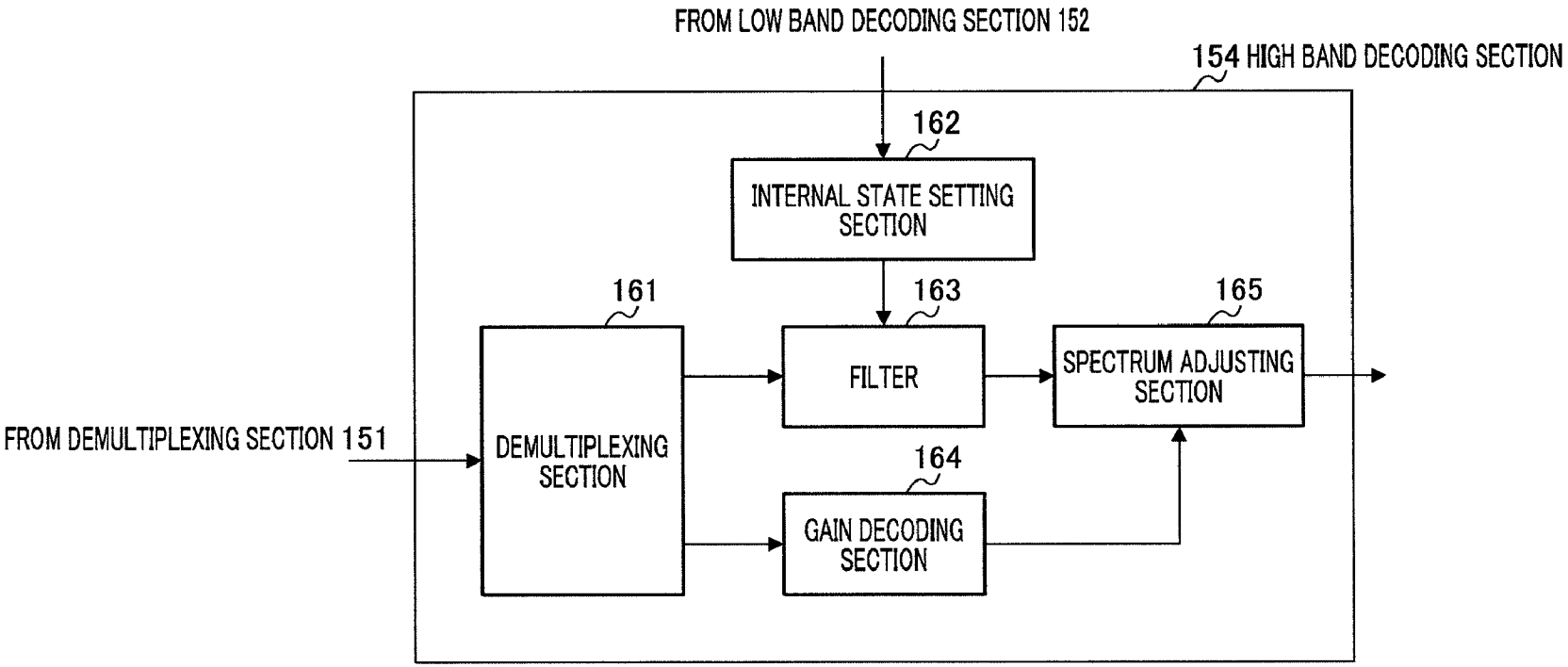
FIG. 8 is a block diagram showing a main configuration inside a high band decoding section according to Embodiment 1.

FIG. 8 is a block diagram showing a main configuration inside above high band decoding section 154.

Internal state setting section 162 receives an input of a decoded low band spectrum from low band decoding section 152. Internal state setting section 162 sets this decoded low band spectrum as the internal state of filter 163.

On the other hand, demultiplexing section 161 receives an input of high band coded data from demultiplexing section 151. Demultiplexing section 161 separates this high band coded data to information related to filtering coefficients (the index for optimum pitch coefficient T') and information related to the gain (the index for the variation $V_q(j)$), and outputs information related to the filtering coefficients and information related to the gain to filter 163 and gain decoding section 164, respectively.

Filter section 163 performs filtering processing of the decoded low band spectrum based on the internal state of a filter set by internal state setting section 162 and pitch coefficient T' outputted from demultiplexing section 161 and calculates a decoded spectrum of an estimated spectrum. Filter 163 uses the filter function represented by above equation 4.

Gain decoding section 164 decodes gain information outputted from demultiplexing section 161 and finds the variation $V_q(j)$ which is a decoding parameter of V(j).

Spectrum adjusting section 165 adjusts the gain of the decoded spectrum of frequency band Fs/4≦k<Fs/2 by multiplying the decoded spectrum outputted from filter 163 by the decoded gain parameter outputted from gain decoding section 164, and generates the decoded spectrum after the gain adjustment. This decoded spectrum after the gain adjustment is outputted to spectrum rearranging section 155 as the decoded high band spectrum. To explain this processing with an equation, by multiplying decoded spectrum S'(k) outputted from filter 163 by the decoded gain parameter outputted from gain decoding section 164, that is, the variation $V_q(j)$ per subband, according to following equation 6, it is possible to find decoded spectrum S3(*k*) after the gain adjustment.

$$S3(k)=S'(k)\cdot V_q(j)(BL(j)\leqq k\leqq BH(j), \text{ for all } j) \quad \text{(Equation 6)}$$

As described above, according to this embodiment, by rearranging the spectral components in the high band spectrum in the frequency domain to be reverse at spectrum rearranging section 105, the high band spectrum showing a mirror image is corrected. Then, subsequent high band coding section 107 efficiently encodes the corrected high band spectrum utilizing the low band spectrum. In other words, in subband coding, after the order in the high band spectrum is reverse in the frequency domain, this high band spectrum is encoded. By this means, it is possible to prevent deterioration of coding performance and improve decoded signal sound quality.

Further, the subband coding apparatus according to this embodiment may be assumed to employ a configuration of the scalable coding apparatus. That is, in FIG. 3, if it is assumed that low band coding section 103 supports the first layer coding section and high band coding section 107 supports the second coding section, the subband coding apparatus according to this embodiment may be regarded as a scalable coding apparatus formed with two layers. In this case, multiplexing section 108 generates bit stream S20 by making low band coded data S14 data of high importance for the first layer and high band coded data S19 data of low importance for the second layer.

Figure 9:
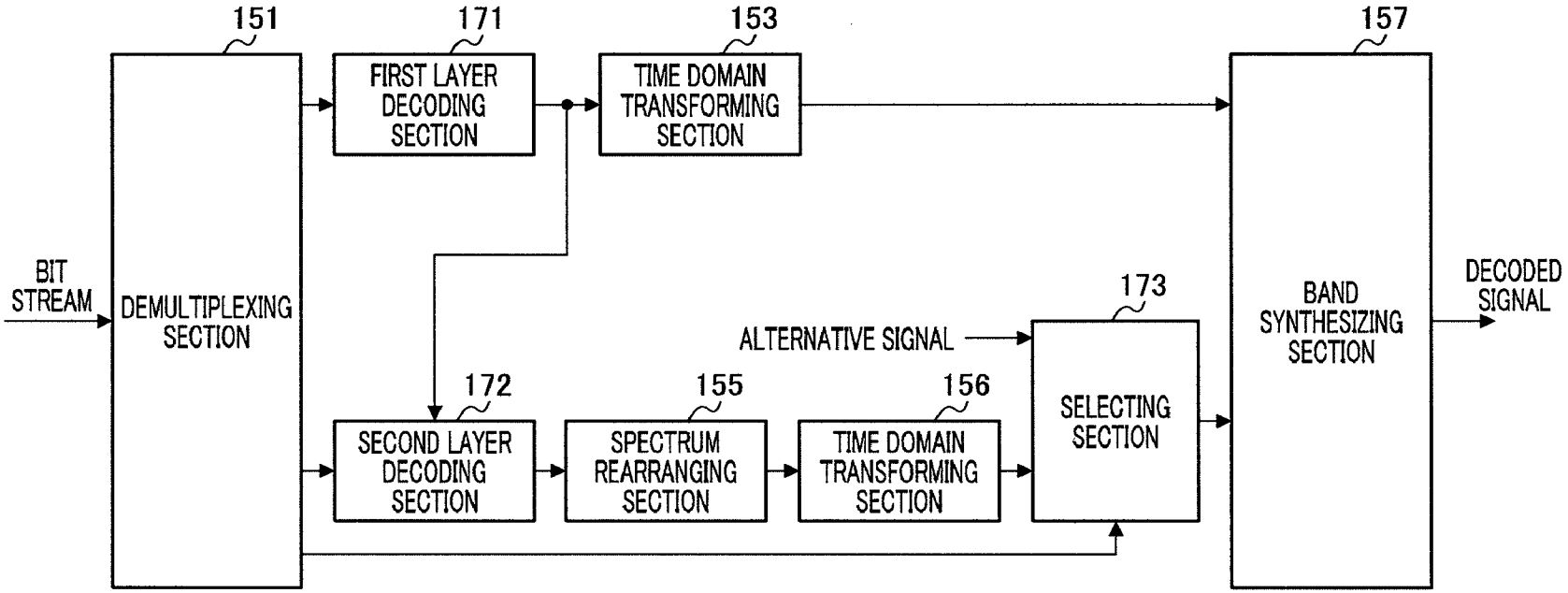
FIG. 9 is a block diagram showing a configuration of the scalable decoding apparatus according to Embodiment 1.

FIG. 9 is a block diagram showing a configuration of a scalable decoding apparatus supporting the above scalable coding apparatus. Further, this scalable decoding apparatus has the same basic configuration as the subband decoding apparatus shown in FIG. 7, and so the same components will be assigned the same reference numerals and repetition of description will be omitted. As shown in this figure, layer information showing coded data of which layer is included in the inputted bit stream, is outputted from demultiplexing section 151 and is inputted to selecting section 173. If the bit stream includes second layer coded data, selecting section 173 outputs the signal from time domain transforming section 156 as is to band synthesizing section 157. On the other hand, if the bit stream does not include second layer coded data, selecting section 173 outputs an alternative signal to band synthesizing section 157. For this alternative signal for example, a signal where all elements have a zero value, is used. If the bit stream does not include second layer coded data, a decoded signal is generated only from a low band signal. Further, for an alternative signal, a decoded high band signal used in a previous frame may be used. Alternatively, a signal attenuated such that the amplitude value of the decoded high band signal used in a previous frame becomes smaller may be used as an alternative signal. By providing such a configuration, if the bit stream includes only first layer coded data, it is possible to generate a decoded signal.

Figure 10:
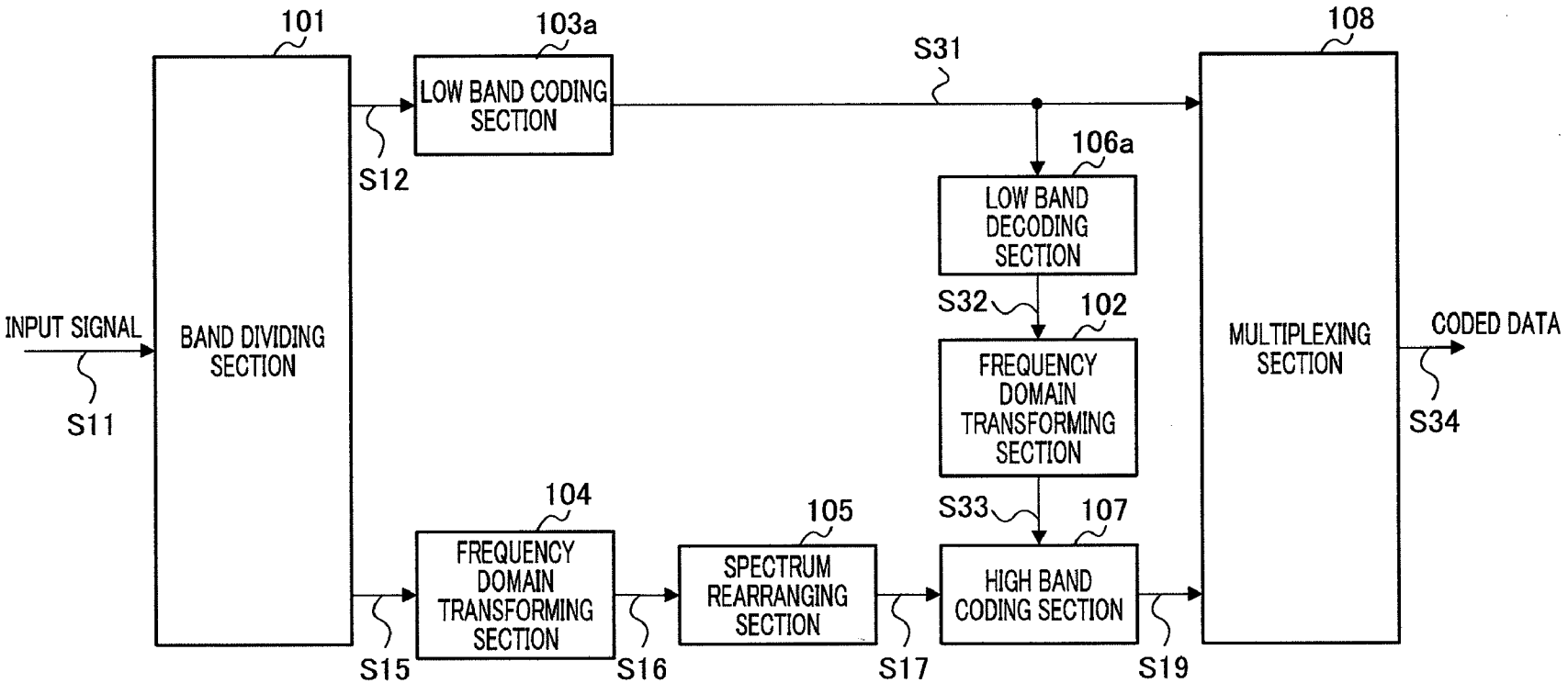
FIG. 10 is a block diagram showing a variation of the configuration of the subband coding apparatus according to Embodiment 1.

Further, the subband coding apparatus according to this embodiment may employ a configuration applying time domain coding of CELP coding and the like instead of spectrum coding of the low band spectrum. That is, in the subband coding apparatus according to this embodiment, time domain coding is used together with spectrum coding of the high band spectrum. FIG. 10 is a block diagram showing a variation of the configuration of the subband coding apparatus according to this embodiment in the above case, that is, the subband coding apparatus according to this embodiment. In this configuration, low band coding section 103*a* encodes time domain signal S12 in the time domain and outputs resulting coded data S31 to low band decoding section 106*a*. In this way, low band decoding section 106*a* obtains decoded time domain signal S32 by decoding coded data S31. Then, decoded time domain signal S32 is transformed into a frequency domain signal, that is, spectrum S33, by frequency domain transforming section 102 provided at a subsequent stage to low band decoding section 106*a* and is outputted to high band coding section 107. Other processings are as already described.

Figure 11:
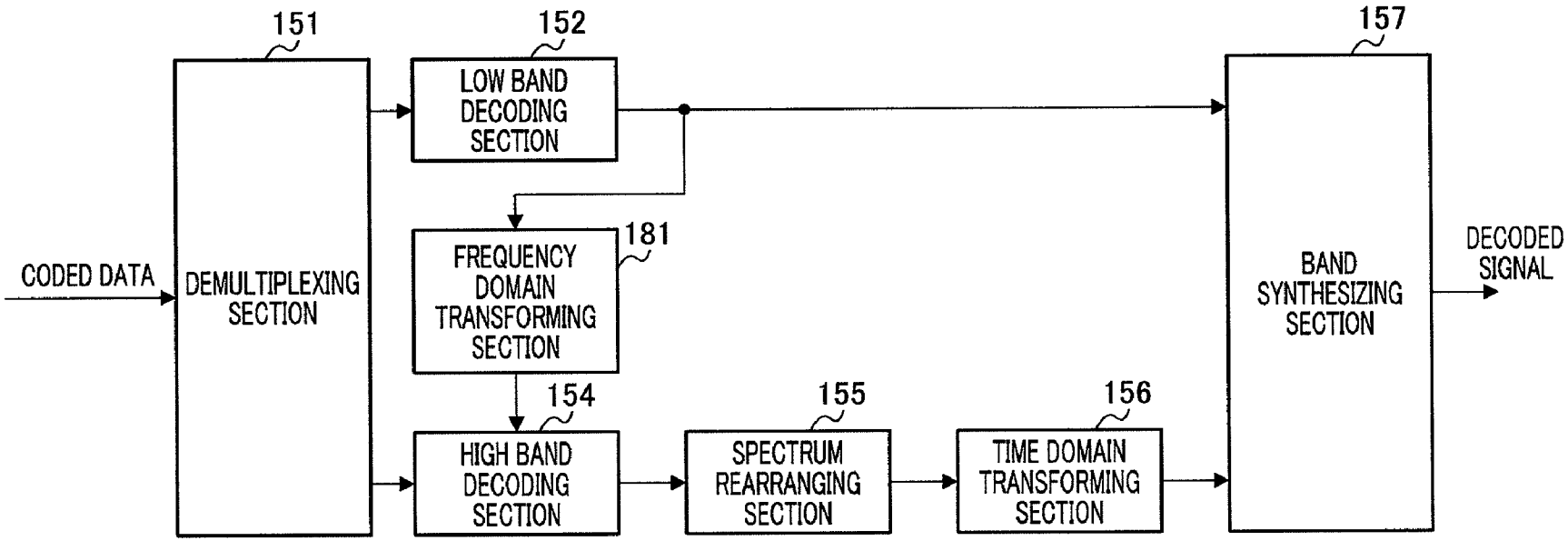
FIG. 11 is a block diagram showing a variation of the configuration of the subband decoding apparatus according to Embodiment 1.

FIG. 11 is a block diagram showing a variation of the configuration of the subband decoding apparatus supporting the subband coding apparatus shown in FIG. 10, that is, the configuration of the subband decoding apparatus according to this embodiment. Similar to the coding side as in this apparatus, frequency domain transforming section 181 is provided at a subsequent stage to low band decoding section 152. Further, it naturally follows that time domain transforming section 153 shown in the subband decoding apparatus of FIG. 7 is not necessary.

Figure 12:
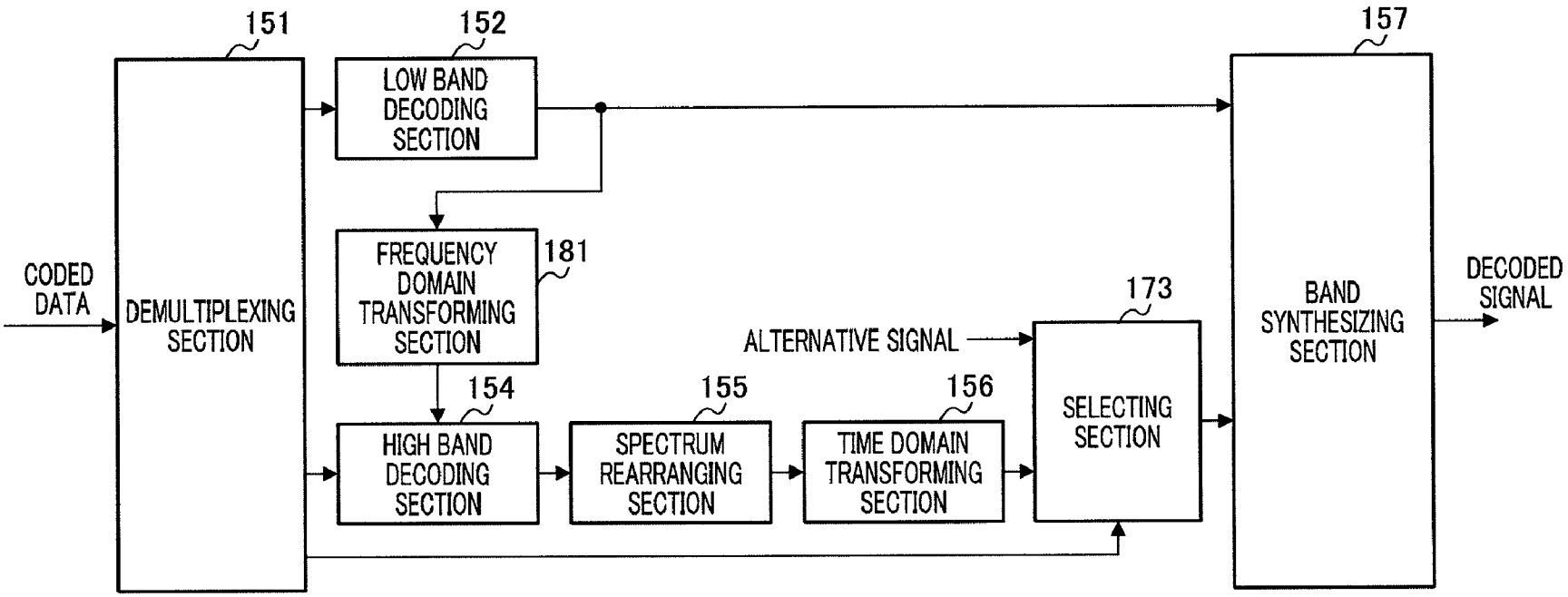
FIG. 12 is a block diagram showing another variation of the configuration of the subband decoding apparatus according to Embodiment 1.

Further, FIG. 12 is a block diagram showing the configuration on the decoding side in a case where, in coding and decoding of a low band signal in this embodiment, time domain coding and decoding are applied and the scalable configuration is employed, that is, another variation of the configuration of the subband decoding apparatus according to this embodiment. The basic configuration of this subband decoding apparatus is the same as the subband decoding apparatus shown in FIG. 11.

This subband decoding apparatus further has selecting section 173 shown in FIG. 9.

Embodiment 2

Figure 13:
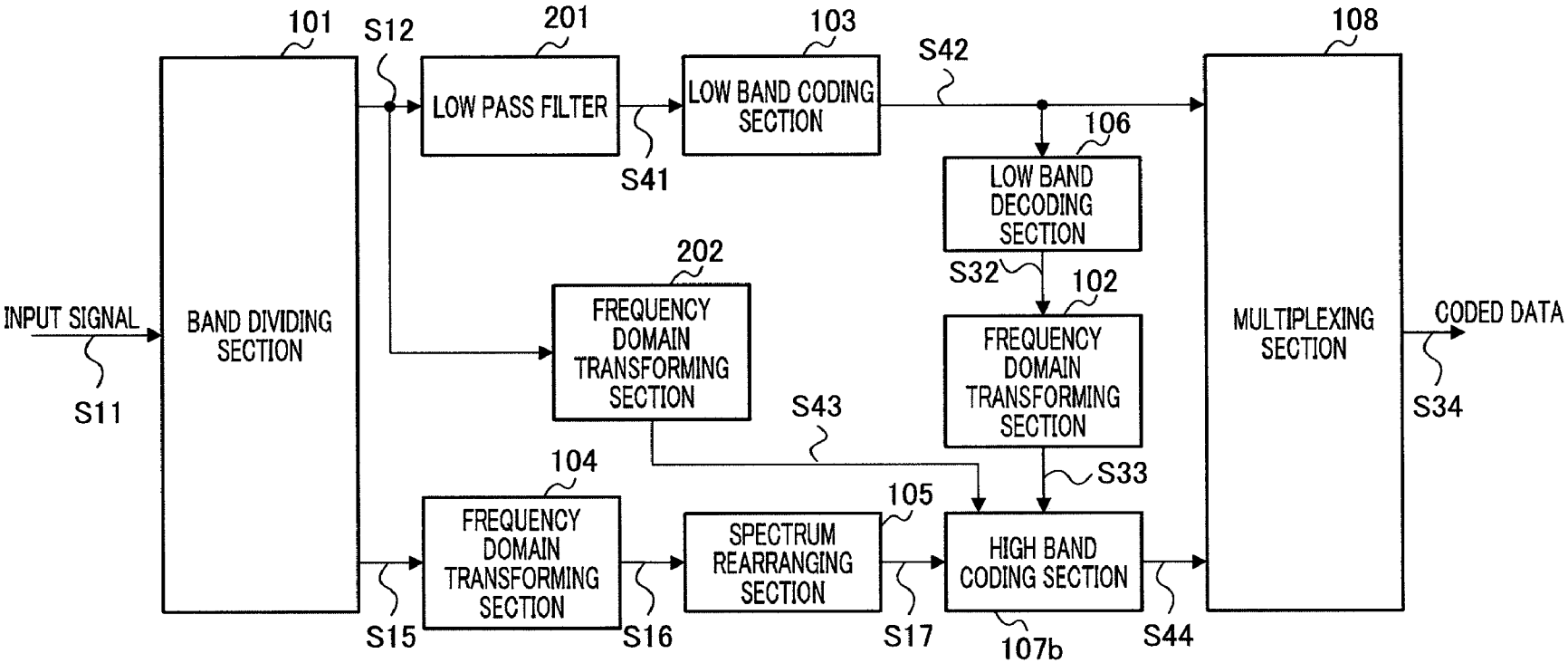
FIG. 13 is a block diagram showing a main configuration of the subband coding apparatus according to Embodiment 2.

FIG. 13 is a block diagram showing a main configuration of the subband coding apparatus according to Embodiment 2 of the present invention.

If the sampling frequency for input signals is, for example, Fs=16 kHz, the subband coding apparatus according to Embodiment 1 encodes signals of components of bands up to 4 kHz in low band coding section 103. However, a general speech communication system such as a fixed line telephone and a mobile phone is designed such that signals subjected to band limitation to 3.4 kHz are used in communication. That is, in a coding apparatus, signals of bands between 3.4 kHz and 4 kHz are cut off on the communication system side and so cannot be used. Under this environment, in a coding apparatus, by cutting off signals of bands between 3.4 and 4 kHz in advance and designing a low band coding section to encode only signals after the cutoff, it is possible to realize higher sound quality (however, in the case where only low band signals are decoded).

Then, the subband coding apparatus according to this embodiment provides low pass filter 201 at a preceding stage to low band coding section 103 and makes input signals of low band coding section 103 low band signals subjected to band limitation by low pass filter 201. For example, with the example of the above communication system, cutoff frequency F1 is 3.4 kHz.

Figure 14:
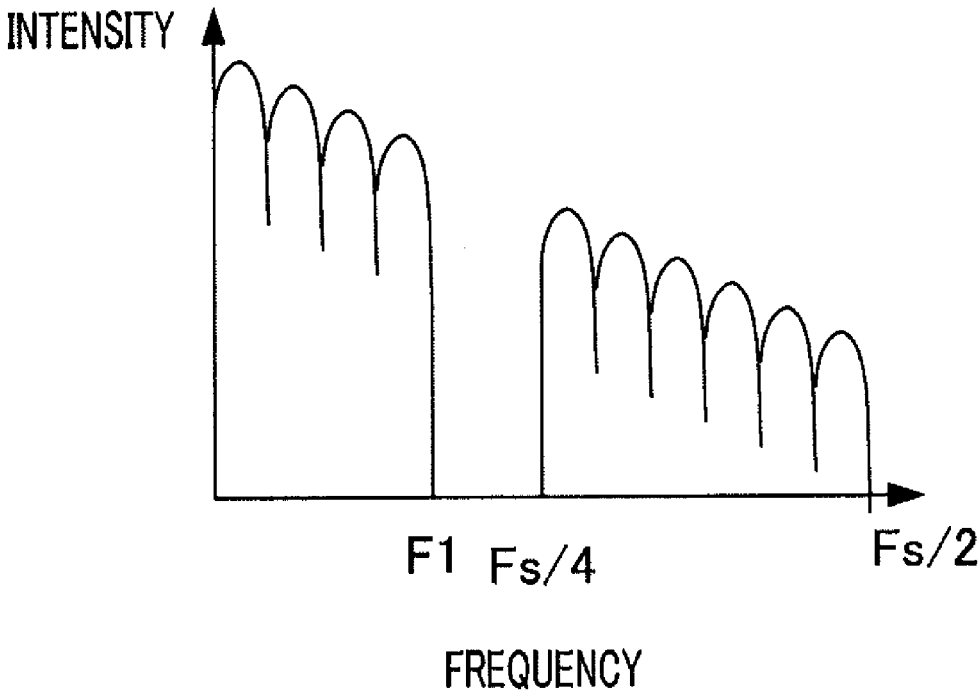
FIG. 14 shows an example of the spectrum of a decoded signal.

Further, in this case, if a signal of band 0 to Fs/2 is decoded utilizing coded data generated at high band coding section 107 shown in Embodiment 1, this decoded signal spectrum is as shown in FIG. 14. That is, in the band F1 to Fs/4, a dip (a no-spectrum interval where there is no spectrum) is produced in the spectrum. If this no-spectrum interval occurs, this causes deterioration of decoded signal sound quality.

Further, by separately inputting the spectrum of band $0 \leqq k < Fs/4$ to high band coding section 107, the subband coding apparatus according to this embodiment enables high band coding section 107 to use the spectrum of band F1 to Fs/2 as the target spectrum of coding processing loop (so this section is referred to as high band coding section 107*b* to be distinguished from high band coding section 107). By this means, high band coding section 107*b* is able to encode the spectrum of band F1 to Fs/2, prevent the occurrence of the above described no-spectrum interval and improve decoded signal sound quality.

The configuration of the subband coding apparatus according to this embodiment will be described more in detail. Further, this subband coding apparatus has the same basic configuration as a variation of the subband coding apparatus according to Embodiment 1 shown in FIG. 10, the same components as in FIG. 10 will be assigned the same reference numerals and repetition of description will be omitted.

Low pass filter 201 cuts off band $F1 \leqq k < Fs/4$ of band $0 \leqq k < Fs/4$ of time domain low band signal S12 given from band dividing section 101, and outputs signal S41 of band $0 \leqq k < F1$, to low band coding section 103. For example, in a communication system where the band is limited to 3.4 kHz, cutoff frequency F1=3.4 kHz is used.

Low band coding section 103 carries out coding processing of time domain signal S41 of band $0 \leqq k < F1$ outputted from low pass filter 201 and outputs resulting coded data S42 to multiplexing section 108 and low band decoding section 106.

On the other hand, frequency domain transforming section 202 carries out a frequency analysis of time domain low band signal S12 given from band dividing section 101, transforms time domain low band signal S12 into a frequency domain signal, that is, low band spectrum S43 and outputs low band spectrum S43 to high band coding section 107*b*.

High band coding section 107*b* receives an input of decoded low band spectrum S33 of band $0 \leqq k < F1$ from frequency domain transforming section 102, an input of low band spectrum S43 of band $0 \leqq k < Fs/4$ from frequency domain transforming section 202 and an input of corrected high band spectrum of band $Fs/4 \leqq k < Fs/2$ from spectrum rearranging section 105. High band coding section 107*b* encodes the spectrum of band $F1 \leqq k < Fs/2$ using band $F1 \leqq k < Fs/4$ out of low band spectrum S43 of band $0 \leqq k < Fs/4$ inputted from frequency domain transforming section 202, and outputs resulting coded data S44 to multiplexing section 108.

Figure 15:
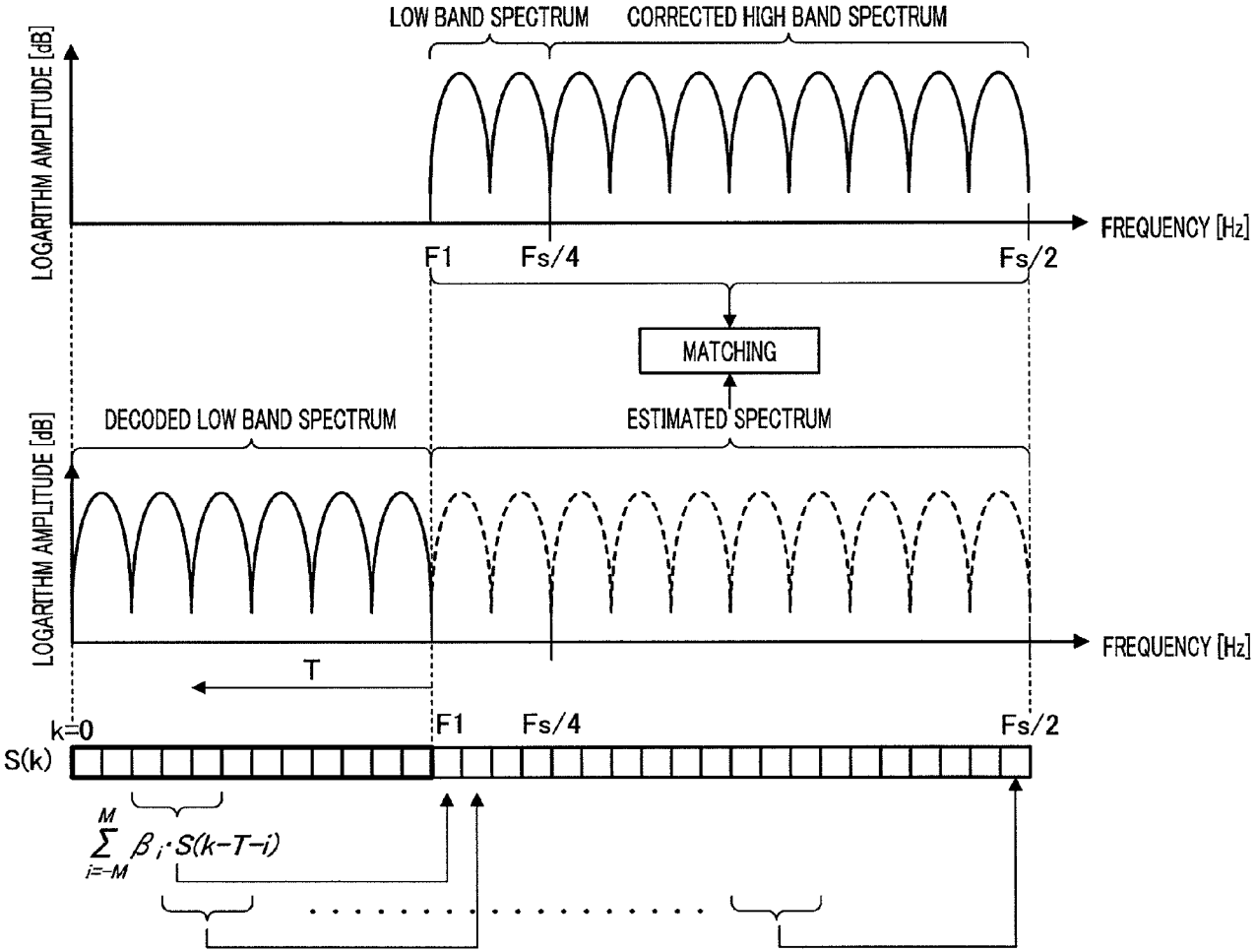
FIG. 15 illustrates coding processing of the high band coding section according to Embodiment 2.

FIG. 15 illustrates coding processing of high band coding section 107*b*.

The filtering processing carried out at filter 112*b* in high band coding section 107*b* is basically the same as the filtering processing at filter 112 described in Embodiment 1. However, the target spectra are different. To be more specific, the decoded low band spectrum of band $0 \leqq k < F1$ is used as S1(*k*) and the low band spectrum of band $F1 \leqq k < Fs/4$ and the corrected high band spectrum of band $Fs/4 \leqq k < Fs/2$ are used as the target spectra for the coding processing loop. In this way, the band of estimated spectrum S2'(k) is $F1 \leqq k < Fs/2$.

Figure 16:
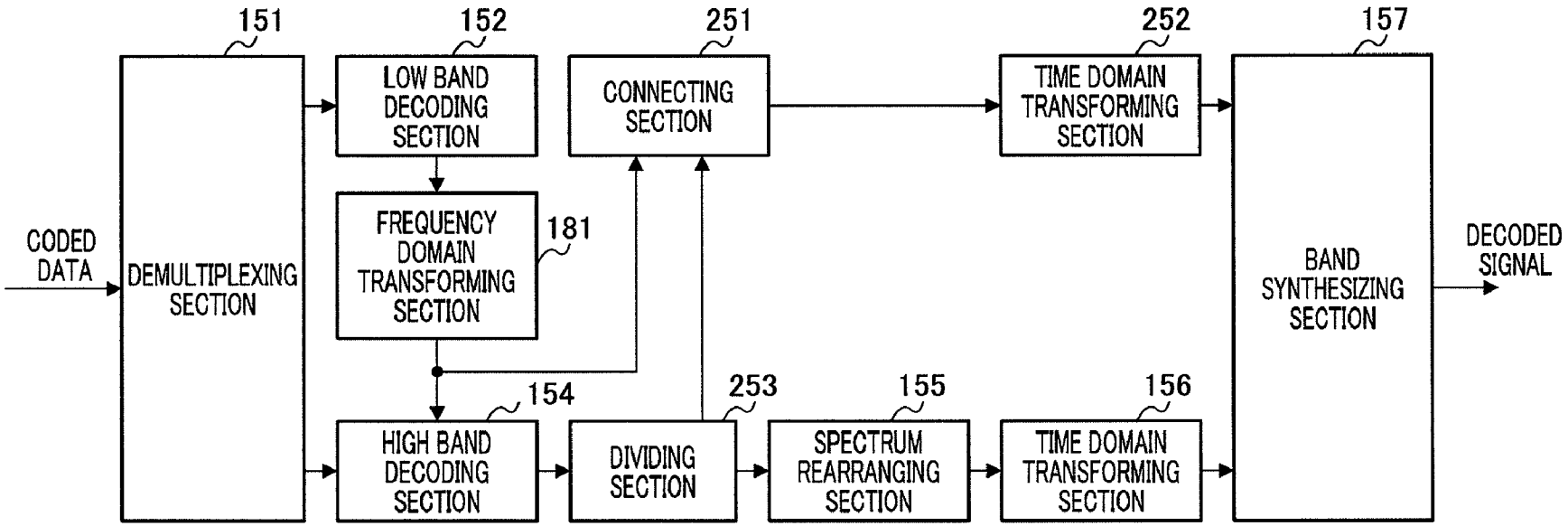
FIG. 16 shows a configuration of the subband decoding apparatus according to Embodiment 2.

Next, the configuration of the subband decoding apparatus according to this embodiment supporting the above subband coding apparatus will be described using FIG. 16. Further, this subband decoding apparatus has the same basic configuration as the subband decoding apparatus shown in FIG. 11, and so the same components as in FIG. 11 will be assigned the same reference numerals and repetition of description will be omitted.

Frequency domain transforming section 181 carries out a frequency analysis of a decoded low band signal given from low band decoding section 152, generates a decoded low band spectrum of band $0 \leqq k < F1$ and outputs the decoded low band spectrum to high band decoding section 154.

High band decoding section 154 generates a decoded high band spectrum using the high band coded data outputted from demultiplexing section 151 and the decoded low band spectrum outputted from frequency domain transforming section 181. A decoded high band spectrum of band $F1 \leqq k < Fs/2$ is generated by this decoding processing and is outputted to dividing section 253.

Dividing section 253 divides the decoded high band spectrum outputted from high band decoding section 154 to two bands of $F1 \leqq k < Fs/4$ and $Fs/4 \leqq k < Fs/2$, and outputs two bands of $F1 \leqq k < Fs/4$ and $Fs/4 \leqq k < Fs/2$ to connecting section 251 and spectrum rearranging section 155, respectively.

Connecting section 251 connects the decoded low band spectrum of band $0 \leqq k < F1$ outputted from frequency domain transforming section 181 and the decoded high band spectrum of band $F1 \leqq k < Fs/4$ outputted from dividing section 253, generates the connected low band spectrum of band $0 \leqq k < Fs/4$ and outputs this connected low band spectrum to time domain transforming section 252.

Time domain transforming section 252 transforms the connected low band spectrum into a time domain signal and outputs this signal as a decoded low band signal to band synthesizing section 157.

In this way, in subband coding, this embodiment employs a configuration of further carrying out band limitation and coding of the low band signal. Then, the high band spectrum and the low band spectrum in which the band is cut off are encoded. By this means, it is possible to prevent occurrence of a no-spectrum interval and improve decoded signal sound quality.

Further, as in Embodiment 1, the subband coding apparatus according to this embodiment is regarded as a scalable coding apparatus.

Figure 17:
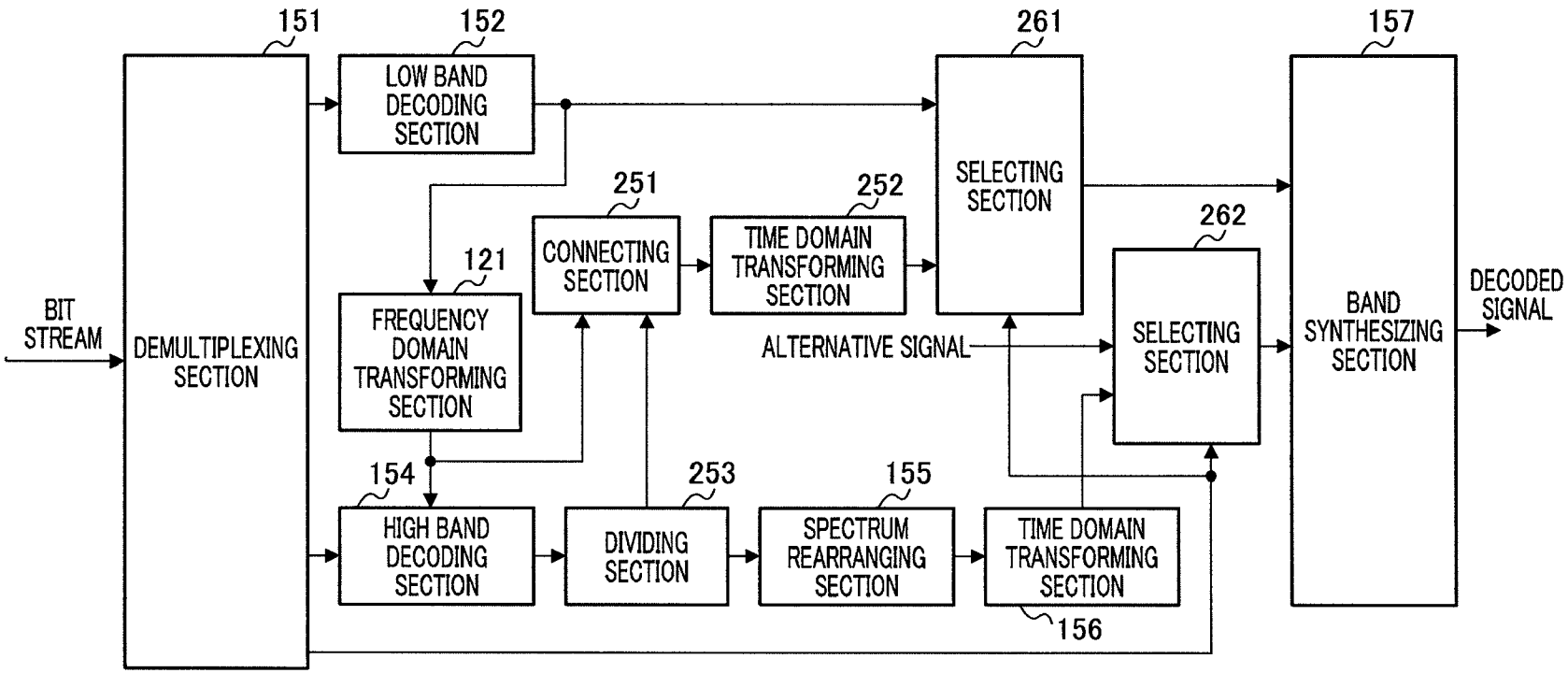
FIG. 17 is a block diagram showing a configuration of the scalable decoding apparatus according to Embodiment 2.

FIG. 17 is a block diagram showing the configuration of an applicable decoding apparatus in a case where the subband coding apparatus according to this embodiment is regarded as the scalable coding apparatus. Further, this scalable decoding apparatus has the same basic configuration as the subband decoding apparatus shown in FIG. 16, and so the same components will be assigned the same reference numerals and repetition of description will be omitted. As shown in this figure, demultiplexing section 151 outputs layer information showing coded data of which layer is included in an inputted bit stream, to selecting section 261 and selecting section 262. If the bit stream includes second layer coded data, selecting section 261 outputs the signal from time domain transforming section 252 to band synthesizing section 157 and selecting section 262 outputs the signal from time domain transforming section 156 to band synthesizing section 157. If the bit stream does not include second layer coded data, selecting section 261 outputs the signal from low band decoding section 152 to band synthesizing section 157, and selecting section 262 outputs an alternative signal to band synthesizing section 157. For this alternative signal for example, a signal where all elements have a zero value is used. If a bit stream does not include second layer coded data, a decoded signal is generated only from the low band signal. Further, for an alternative signal, a decoded high band signal used in a previous frame may be used. Alternatively, a signal attenuated such that the amplitude value of the decoded high band signal used in a previous frame becomes smaller may be used as an alternative signal. By providing such a configuration, if a bit stream includes only first layer coded data, it is possible to generate a decoded signal.

Embodiments of the present invention have been described.

Further, the FFT, DFT, DCT, MDCT, filter band and the like may be used as frequency transform processing in the frequency transforming section.

Further, both speech signals and audio signals may be used as input signals.

The subband coding apparatus and subband coding method according to the present invention are not limited to the above embodiments and can be realized by making various modifications. For example, the embodiments can be realized by appropriate combinations.

The subband coding apparatus according to the present invention can be provided in a communication terminal apparatus and base station apparatus in a mobile communication system, so that it is possible to provide a communication terminal apparatus, base station apparatus and mobile communication system having same advantages and effects as described above.

Also, although cases have been described with the above embodiment as examples where the present invention is configured by hardware, the present invention can also be realized by software. For example, it is possible to implement the same functions as in the base station apparatus according to the present invention by describing algorithms of the radio transmitting methods according to the present invention using the programming language, and executing this program with an information processing section by storing in memory.

Each function block employed in the description of each of the aforementioned embodiments may typically be implemented as an LSI constituted by an integrated circuit. These may be individual chips or partially or totally contained on a single chip.

"LSI" is adopted here but this may also be referred to as "IC," "system LSI," "super LSI," or "ultra LSI" depending on differing extents of integration.

Further, the method of circuit integration is not limited to LSI's, and implementation using dedicated circuitry or general purpose processors is also possible. After LSI manufacture, utilization of a programmable FPGA (Field Programmable Gate Array) or a reconfigurable processor where connections and settings of circuit cells within an LSI can be reconfigured is also possible.

Further, if integrated circuit technology comes out to replace LSI's as a result of the advancement of semiconductor technology or a derivative other technology, it is naturally also possible to carry out function block integration using this technology. Application of biotechnology is also possible.

The present application is based on Japanese Patent Application No. 2005-347342, filed on Nov. 30, 2005, the entire content of the specification, drawings and abstract of which is expressly incorporated by reference herein.

INDUSTRIAL APPLICABILITY

The subband coding apparatus and the subband coding method according to the present invention are applicable for use in a communication terminal apparatus and base station apparatus in a mobile communication system.

The invention claimed is:

1. A subband coding apparatus, comprising:

divider that divides an input signal into a plurality of subband signals;

a transformer that carries out a frequency domain transform of at least one of the plurality of subband signals and generates a subband spectrum;

a rearranger that rearranges an order of spectral components in the subband spectrum to be reverse and generates a reverse order spectrum; and a coder that encodes the reverse order spectrum using a decoded subband spectrum originating from at least one of the other subband signals.

2. A subband coding apparatus, comprising:

a divider that divides an input signal into at least a low subband signal and a high subband signal;

a first coder that encodes the low subband signal and generates a low band coded parameter;

a decoder that decodes the low band coded parameter and generates a low band decoded signal;

a transformer that carries out a frequency domain transform of the high subband signal and generates a high subband spectrum;

a rearranger that rearranges an order of spectral components in the high subband spectrum to be reverse in the frequency domain and generates a reverse order high band spectrum; and a second coder that encodes the high band subband spectrum using the low band decoded signal and the reverse order high band spectrum.

3. The subband coding apparatus according to claim 2, further comprising a low pass filter that cuts off a high band component of the low subband signal, at a stage preceding the first coder, wherein the second coder separately inputs a spectrum of the low subband signal and encodes the high subband spectrum using the spectrum, the low band decoded signal not including the high band component, and the reverse order high band spectrum.

4. A communication terminal apparatus comprising the subband coding apparatus according to claim 1.

5. A base station apparatus comprising a subband coding apparatus according to claim 1.

6. A subband coding method, comprising:

dividing an input signal into a plurality of subband signals using a divider;

carrying out a frequency domain transform of the subband signal and generating a subband spectrum using a transformer;

rearranging an order of spectral components in the subband spectrum to be reverse in the frequency domain and generating a reverse order spectrum, using a rearranger; and encoding, using an encoder, the reverse order spectrum using a decoded subband spectrum originating from at least one of the other subband signals.

* * * * *

UNITED STATES PATENT AND TRADEMARK OFFICE

CERTIFICATE OF CORRECTION

PATENT NO. : 8,103,516 B2
APPLICATION NO. : 12/095548
DATED : January 24, 2012
INVENTOR(S) : M. Oshikiri It is certified that error appears in the above-identified patent and that said Letters Patent is hereby corrected as shown below:

At column 13, line 34 (claim 1) of the printed patent, please insert --a-- before divider.

Signed and Sealed this
Eighth Day of May, 2012

David J. Kappos

David J. Kappos
*Director of the United States Patent and Trademark Office*